US005366952A

United States Patent [19]

Granquist

[11] Patent Number: 5,366,952

[45] Date of Patent: Nov. 22, 1994

[54] DOUBLE-SURFACE HEAT-SENSITIVE RECORD MATERIAL

[75] Inventor: Russell E. Granquist, Charlton City, Mass.

[73] Assignee: Kanzaki Specialty Papers, Ware, Mass.

[21] Appl. No.: 902,019

[22] Filed: Jun. 22, 1992

[51] Int. Cl.[5] ..... B41M 5/30; B41M 5/34; B41M 5/40

[52] U.S. Cl. ..... 503/204; 427/152; 503/200; 503/214; 503/226

[58] Field of Search ..... 427/152; 503/200, 204, 503/226, 214

[56] References Cited

U.S. PATENT DOCUMENTS

| | | | |
|---|---|---|---|
| 3,343,663 | 9/1967 | Seidler | 156/244.16 |
| 3,451,876 | 6/1969 | Edelmann et al. | 156/244.16 |
| 3,684,643 | 8/1972 | Stepp | 161/160 |
| 3,799,827 | 3/1974 | Takimoto et al. | 156/219 |
| 4,311,750 | 1/1982 | Kubo et al. | 428/212 |
| 4,389,438 | 6/1983 | Ohtsuki et al. | 428/35 |
| 4,523,207 | 6/1985 | Lewis et al. | 346/214 |
| 4,569,712 | 2/1986 | Shibano et al. | 156/244.14 |
| 4,613,878 | 9/1986 | Inaba et al. | 503/204 |
| 4,853,256 | 8/1989 | Obringer et al. | 427/152 |
| 5,055,152 | 10/1991 | Inagaki | 156/244.11 |
| 5,098,497 | 3/1992 | Brinley | 156/219 |

*Primary Examiner*—B. Hamilton Hess
*Attorney, Agent, or Firm*—Mary R. Bonzagni

[57] ABSTRACT

A double-surface heat-sensitive record material is disclosed that provides separable, thermally printed surfaces. The invention includes a first heat-sensitive record surface having an exposed heat-sensitive record layer on one surface, a pressure-sensitive adhesive layer, and release liner on an opposed surface. A second heat-sensitive record surface includes a second heat-sensitive record layer on an exposed surface. This second record surface is secured to the first record surface, by a binder layer, to form a double-surface heat-sensitive record material having opposed, exposed heat-sensitive record layers. A thermal imager or printer can then print on both exposed heat-sensitive record layers. The release liner enables the two record layers to be separated, forming first and second printed surfaces, wherein the first printed surface has an exposed pressure-sensitive adhesive layer so that it can be readily used as a label, while the second printed surface may be used as a receipt.

7 Claims, 1 Drawing Sheet

DOUBLE-SURFACE HEAT-SENSITIVE RECORD MATERIAL

BACKGROUND OF THE INVENTION

The present invention relates to heat-sensitive record materials, such as recording media for facsimile printers. In particular, a double-surface heat-sensitive record material is disclosed for use in generating at least two separable printed surfaces, such as a label and a receipt.

Heat-sensitive record materials generate colored images by thermally bringing a color-forming material into contact with a color-developing material. A recording apparatus is utilized to apply thermal energy in the shape of the desired image. Typical recording printers are found in facsimile machines, cash registers, and measuring instruments. Heat-sensitive record materials have gained widespread popularity, because of the ease of maintenance of the recording apparatuses, which do not require ink transfer materials (e.g., an ink ribbon or tape) and typically utilize virtually no moving parts to transfer the thermal energy to the record material. Relatively thick, heat-sensitive record materials have recently been used as durable product labels, that display machine-readable "bar-code" information, and human-readable, traditional letters and/or numbers.

Heat-sensitive record material is produced by applying a heat-sensitive coating composition to a base support sheet via conventional paper coating procedures. Once heat-sensitive record material is prepared by such a process, subsequent processing is severely limited because the material is thereafter subject to deleterious discoloring when exposed to heat levels associated with ordinary paper processing. Consequently, the variety of heat-sensitive record materials available has been limited.

For example, a common label that utilizes a heat-sensitive record layer is widely utilized in package delivery. First, the label has information thermally imaged or printed onto the heat-sensitive record layer by a hand-held recording apparatus, typically operated by an individual picking up the package for delivery. The label then has a release liner peeled away from a surface opposed to the information-bearing, heat-sensitive record layer, thereby exposing a pressure-sensitive adhesive layer. The label is then affixed to the package, and the release liner is discarded.

In producing such a label, a heat-sensitive composition is applied to a first base support sheet. Then a second support sheet or release liner is coated with a pressure-sensitive adhesive, and the two support sheets are laminated together by a cold lamination process, such as press rolling, to form the label material.

To avoid duplicative clerical work and inefficient disposal of the release liner after application of the label to the package, it is desirable to further process the label material, by, for example, applying another layer of heat-sensitive coating compound to the release liner, so that the release liner could be simultaneously printed to produce a receipt. Further processing, however, has so far proven impractical for two primary reasons. First, coating a second heat-sensitive record layer directly to the release liner side of the label material at an efficient manufacturing, or "line", speed necessarily involves exposure of the previously applied, or first, heat-sensitive record layer to levels of heat and chemicals that cause the first layer to prematurely color, or develop a fogginess, rendering the product unusable. Second, coating a second heat-sensitive record layer directly onto the release layer side of the label material at an efficient line speed is not technically feasible because the thickness or bulk of the label material renders requisite uniform coating of the heat-sensitive coating composition impossible.

Accordingly, it is the general object of the present invention to provide a double-surface heat-sensitive record material that overcomes the problems of the prior art.

It is a more specific object to provide a double-surface heat-sensitive record material which enables simultaneous thermal imaging or printing of two separable opposed surfaces.

It is another specific object to provide a double-surface heat-sensitive record material which can be produced at efficient manufacturing or line speeds.

It is yet another specific object to provide a double-surface heat-sensitive record material which can be produced without discoloration of any of the heat-sensitive record material.

The above and other objects and advantages of this invention will become more readily apparent when the following description is read in conjunction with the accompanying drawings.

SUMMARY OF THE INVENTION

A double-surface heat-sensitive record material is disclosed for providing separable thermally imaged or printed surfaces. A recording apparatus such as a thermal printer may print opposed sides of the record material, so that, after separation of the surfaces, one side may serve as a package label, and the other side may serve as a receipt.

In a preferred embodiment, the invention comprises a first heat-sensitive record surface and a second heat-sensitive record surface secured together by a binder layer. The first heat-sensitive record surface includes: a first base support sheet having opposed top and bottom surfaces, wherein the top surface is coated with an exposed first heat-sensitive record layer; and, a release liner having opposed top and bottom surfaces, wherein a pressure-sensitive adhesive layer affixed to the liner's top surface is secured to the bottom surface of the first base support sheet, so that the pressure-sensitive adhesive contacts the bottom surface of the first base support sheet.

The second heat-sensitive record surface includes a second base support sheet having opposed top and bottom surfaces, wherein the bottom surface is coated with an exposed second heat-sensitive record layer. The top surface of the second base support sheet is secured to the bottom surface of the release liner by a binder layer consisting of a thermoplastic polymer having a vicat softening temperature that is less than 180° C.

Preparation of the preferred embodiments of the double-surface heat-sensitive record material includes the steps of applying the binder layer simultaneously to the top surface of the second base support sheet of the second heat-sensitive record surface, and to the bottom surface of the release liner of the first heat-sensitive record surface, adjacent a chill roll; and, immediately thereafter, securing the first heat-sensitive record surface, binder layer and second heat-sensitive record surface together by passing them between the chill roll and a support roll, to counteract the deleterious effects of the heat in the binder layer.

In use of the double-surface heat-sensitive record material, a thermal printer produces indicia on both the first and second heat-sensitive record layers, and the release liner is peeled away from the pressure-sensitive layer. This peeling separates a first printed surface from a second printed surface, wherein the first printed surface has a pressure-sensitive adhesive so that it may be used as a label, and the second printed surface may be used as a receipt.

DETAILED DESCRIPTION OF THE PREFERRED EMBODIMENTS

Figure 1:
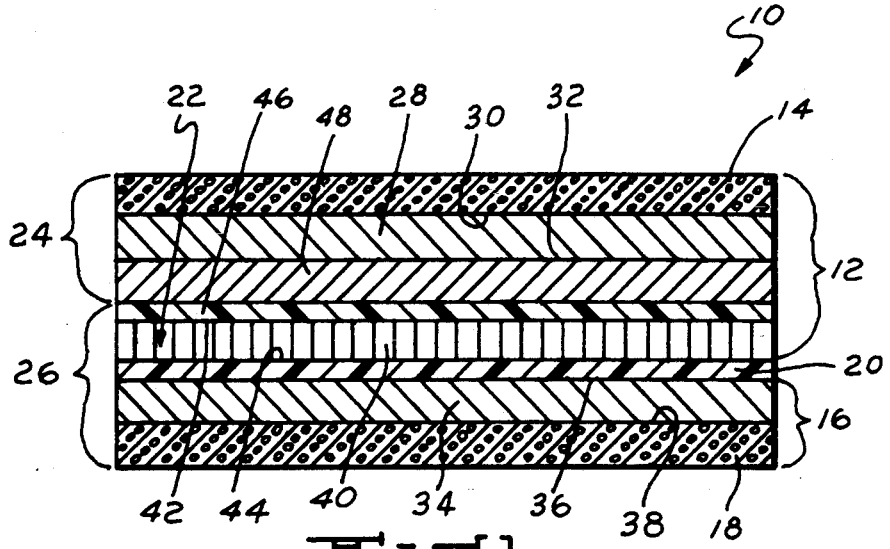
FIG. 1 is a cross-sectional view of a double-surface heat-sensitive record material constructed in accordance with the present invention.

Referring to the drawings in detail, the preferred embodiment of a double-surface heat-sensitive record material of the present invention is shown and generally designated by the reference numeral 10. As shown in FIG. 1, the invention basically comprises a first heat-sensitive record surface 12 having an exposed first heat-sensitive record layer 14; a second heat-sensitive record surface 16 having an exposed second heat-sensitive record layer 18; and a binder layer 20 that secures first and second heat-sensitive record surfaces 12, 16 together. A release liner 22 within the first heat-sensitive record surface 12 can be used to separate the double-surface heat-sensitive record material into a first printed surface 24 and a second printed surface 26 after a recording apparatus (not shown) has thermally printed first and/or second heat-sensitive record layers 14, 18.

As seen in FIG. 1, first heat-sensitive record surface 12 includes a first base support sheet 28 having a top surface 30 and an opposed bottom surface 32. Similarly, second heat-sensitive record surface 16 includes a second base support sheet 34 having a top surface 36 and opposed bottom surface 38. Examples of such sheets 28, 34 are paper, art paper, coated paper, synthetic resin film, synthetic fiber sheet, plastic laminated paper, non-woven sheet, and foil.

First heat-sensitive record layer 14 is affixed to the top surface 30 of the first base support sheet 28, and second heat-sensitive record layer 18 is affixed to the bottom surface 38 of the second base support sheet 34, as best shown in FIG. 1. First and second record layers 14, 18 are formed by conventional methods such as those described in U.S. Pat. No. 4,727,055 to Aoyagi, et al. That patent is incorporated herein by reference, and has been assigned to the assignee of all rights in the present invention. It is noted that Aoyagi et al. includes detailed disclosure of several elements of the present invention (namely, the first and second heat-sensitive record layers 14, 18 and binder layer 20), however, nothing in Aoyagi et al. discloses or suggests the double-surface heat-sensitive record material of the present invention.

As described in greater detail in Aoyagi et al., first and second record layers 14, 18 may be formed by applying a heat-sensitive coating composition to first and second base sheets 14, 18 by air knife coating or blade coating and then drying the heat-sensitive coating composition. The amount of the coating composition is also not particularly limited but is generally about 2 to about 12 g/m$^2$, preferably about 3 to about 10 g/m$^2$, based on dry weight.

Color forming materials and color developing materials useful for the heat-sensitive record layers 14, 18 are known. These can be, for example, the combination of a colorless or pale-colored basic dye and an inorganic or organic acidic material, and the combination of ferric stearate of like metallic salt of higher fatty acid and gallic acid or like phenol.

Examples of useful colorless or pale-colored basic dyes are those already known and include:

Triarylmethane-based dyes, e.g., 3,3-bis(p-dimethylaminophenyl)-6-dimethylaminophthalide, 3,3-bis(p-dimethylaminophenyl)phthalide, (3-(p-dimethylaminophenyl)-3-(1,2-dimethylindole-3-(2-methylindole-2-yl)-phthalide, 3,3-bis (1,2-dimethylindole-3yl)-5-dimethylaminophtha 3,3-bis(1,2-dimethylindole-3-yl)-6-dimethylaminophthalide, 3,3-bis(9-ethylcarbazole-3-1)-6-dimethylaminophthalide, 3,3-bis(2-phenylindole-3-yl)-6-dimethylaminophthalide, and 3-p-dimethylaminophenyl-3-(1--methylpyrrole-3-yl)-6-dimethylaminophthalide.

Diphenylmethane-based dyes, e.g., 4,4'-bis-dimethylaminobenzhydryl benzyl ether, N-halophenylleucoauramine, and N-2,4,5,-trichlorophenylleucoauramine.

Thiazine-based dyes, e.g., benzoyl-leucomethyleneblue, and p-nitrobenzoyl-leucomethyleneblue.

Spiro-based dyes, e.g., 3-methyl-spiro-dinaphthopyran, 3-ethyl-spiro-dinaphthopyran, 3-phenyl-spiro-dinaphthopyran, 3-benzyl-spiro-dinaphthopyran, 3-methyl-naphtho-(6'-methoxybenzo)spiropyran, and 3-propyl-spiro-dibenzopyran.

Lactam-based dyes, e.g., rhodamine-B-anilinolactam, rhodamine-(p-nitroanilino) lactam, and rhodamine-(o-chloroanilino) lactam.

Fluoran-based dyes, e.g., 3-dimethylamino-7-methoxyfluoran, 3-diethylamino-6-methoxyfluoran, 3-diethylamino-7-methoxyfluoran, 3-diethylamino-7-chlorofluoran, 3-diethylamino-6-methyl-7-chlorofluoran, 3-diethylamino-6,7-dimethyl, 3-(N-ethyl-p-toluidino)-7-methylfluoran, 3-diethylamino-7-(N-acetyl-N-methylamino)-fluoran, 3-diethylamino-73-diethylamino-7-dibenzylaminofluoran, 3-diethylamino-7-(N-methyl-N-benzylamino)-fluoran, 3-diethylamino-7-(N-chloroethyl-N-methylamino)fluoran, 3-diethylamino-7-diethylaminofluoran, 3-(N-ethyl-p-toluidino)-6-methyl-7-phenylaminofluoran, 3-(N-ethyl-p-toluidino)-6-methyl-7-(p-toluidino)fluoran, 3-diethylamino-6-methyl-7-phenylaminofluoran, 3-diethylamino-7-(2-carbomethoxy-phenylamino)fluoran, 3-(N-ethyl-N-isoamylamino)-6-methyl-7-phenylaminofluoran; 3(N-cyclohexyl-N-methylamino)- 6-methyl-7-phenylaminofluoran, 3-pyrrolidino-6-methyl-7-phenylaminofluoran, 3-piperidino-6-methyl-7-phenylaminofluoran, 3-diethylamino-6-methyl-7-xylidinofluoran, 3-diethylamino-7-(o-chlorophenylamino)fluoran, 3-dibutylamino)fluoran, 3-dibutylamino-7-o-chloro-phenylamino)-fluoran, and 3-pyrrolidino-6-methyl-7-p-butylphenylaminofluoran.

Examples of inorganic or organic acidic materials which undergo a color-forming reaction with such basic dyes on contact therewith are those already known, such as inorganic acidic materials including activated clay, acidic clay, attapulgite, bentonite, colloidal silica and aluminum silicate; and organic acidic materials including phenolic compounds such as 4-tert-butylphenol, 4-tert-octylphenol, 4-phenylphenol, 4-acetylphenol, α-naphthol, β-naphthol, hydroquinone, 2,2'-dihydroxydiphenyl, 2,2'-methylenebis-(4-methyl-6-tert-butylphenol), 2,2'-methylenebis-(4-chlorophenol), 4,4'-dihydroxydiphenylmethane, 4,4'-isopropylidenediphenol, 4,4'-isopropylidene-bis (2-tert-butylphenol), 4,4'-sec-butylidenediphenol, 4,4 4,4'-dihydroxydiphenyl sulfide, 4,4'-thiobis (6-tert-butyl-3-methylphenol), 4,4'-dihydroxydiphenyl sulfone, 4-hydroxybenzoic acid benzylester, 4-hydroxyphthalic acid dimethylester, hydroquinone monobenzyl ether, novolak phenol resins and phenolic polymers: aromatic carboxylic acids such as benzoic acid, p-tert-butylbenzoic acid, trichlorobenzoic acid, 3-sec-butyl-4-hydroxybenzoic acid, 3-cyclohexyl-4-hydroxybenzoic acid, 3,5-dimethyl-4-hydroxybenzoic salicylic acid, 3-isopropylsalicylic acid, 3-tert-butylsalicylic acid, 3-benzylsalicylic acid, 3-(α-methylbenzyl)-salicylic acid, 3-chloro-6-(α-methylbenzyl)-salicylic acid, 3,5-di-tertbutylsalicylic acid, 3-phenyl-5-(α,α-dimethylbenzyl)-salicylic acid, 3,5,-die-(α-methylbenzl)-salicylic acid and terephthalic acid: also, salts of such phenolic compounds or aromatic carboxylic acids with polyvalent metals such as zinc, magnesium, aluminum, calcium titanium, manganese, tin and nickel.

For the preparation of the heat-sensitive record material of the present invention, the proportions of the color-forming material and the color-developing material to be incorporated into the record layers are suitably determined according to the kinds of these materials and are not particularly limited. For example, when the combination of a colorless or pale-colored basic dye and an inorganic or organic acidic material is used, 1 to 50 parts by weight, preferably 2 to 10 parts by weight, of the acidic material is used per part by weight of the dye.

These materials are formulated into a heat-sensitive coating composition generally with use of water as a dispersion medium and a stirring or pulverizing device, such as a ball mill, attritor or sand mill, by dispersing the two materials at the same time or separately. Usually the coating composition has incorporated therein a binder, such as starches, hydroxyethyl cellulose, methyl cellulose, carboxymethyl cellulose, gelatin, casein, gum arabic, polyvinyl alcohols, styrene-maleic anhydride, copolymer salt, styrene-acrylic acid copolymer salt, styrenebutadiene copolymer emulsion or the like. The binder is used in an amount of about 5 to about 40% by weight, preferably about 10 to about 30% by weight, based on the total solids content of the composition.

Various auxiliary agents can be further admixed with the heat-sensitive coating composition. Examples of useful auxiliary agents are dispersants, such as sodium diocytylsulfosuccinate, sodium dodecylbenzenesulfonate, sodium lauryl sulfate and fatty acid metallic salts; ultraviolet absorbers of the benzophenone, triazole or like type; defoaming agents; fluorescent dyes; and coloring dyes.

When desired for lowering the melting temperature of the record layers and improving the record sensitivity thereof, a sensitizer can be admixed with the composition in an amount of about 10 to about 1000 parts by weight, preferably about 50 to about 500 parts by weight, per 100 parts by weight of the color-developing material. Examples of useful sensitizers are stearic acid amide, stearic acid methylenebisamide, oleic acid amide, palmitic acid amide, sperm oleic acid amide, coconut fatty acid amide and various other known heat-fusible substances.

Further, when desired, other additives can be incorporated into the composition. Examples of useful additives are waxes such as stearic acid, polyethylene wax, carnauba wax, paraffin wax, calcium stearate and ester wax, and inorganic pigments such as kaolin, clay, talc, calcium carbonate, calcined clay, titanium oxide, kieselguhr, fine granular anhydrous silica and active clay.

Applying such a heat-sensitive coating composition to the top surface 30 of first base support sheet 28 forms the first heat-sensitive record layer 14. Release liner 22 is of standard, known composition, having common elements such as a release sheet 40 (that can be made from the same type of material as the first and second base support sheets 28, 34) that has a top surface 42 and an opposed bottom surface 44, and a silicone layer 46 affixed to the top surface 42. A standard, known pressure-sensitive adhesive layer 48, such as a layer of natural rubber, or a synthetic material such as an acrylic layer, is affixed to silicone layer 46 of the release liner 22, by standard, known coating methods, such as hot melt, solution coating, or water-based coating employing a brush, spray, Mayer bar, etc. Affixing the release liner 22 and the pressure-sensitive adhesive layer 48 to the bottom surface 32 of first base support sheet 28, so that the pressure-sensitive adhesive layer 48 contacts the bottom surface 32, forms the first heat-sensitive record surface 12.

Likewise, applying the previously described heat-sensitive coating composition to the bottom surface 38 of second base support sheet 34 forms the second heat-sensitive record layer 18. Second base support sheet 34 and second heat-sensitive record layer 18 together form the second heat-sensitive record surface 16, as seen in FIG. 1.

A binder layer means or binder layer 20 secures the first and second heat-sensitive record surfaces 12, 16 together, to form the double-surface heat-sensitive record material 10 of the present invention. The binder layer is a thermoplastic polymer described in detail in the aforesaid U.S. Pat. No. 4,727,055 to Aoyagi et al. As is pointed out in Aoyagi et al., the binder layer comprises a thermoplastic polymer that is not particularly limited insofar as it meets the conditions of having a vicat softening point of less than 180° C. However, from the point of view of adhesion efficiency, easiness of handling, etc., the following are preferred: polyethylene resin, polypropylene resin, polystyrene resin, polyvinylchloride resin, polyvinylidene chloride resin, ethylene-vinyl acetate copolymer resin, butyral resin, polyester resin, polyamide resin, polyacrylic resin, polynitrilic resin, polybutadienic resin, halogenated rubber, urethanic resin, cellulose resin, gelatin or copolymers consisting of monomers of these resins.

Among these polymers, the following are particularly preferred because they do not invite any problem of causing lowering of the heat-sensitive record characteristics for the heat-sensitive record layers, when applied to the first and second heat-sensitive record surfaces 12, 16: low density polyethylene, atactic polypropylene, ethylenevinyl acetate copolymer, ethyleneacrylic acid copolymer salt, ethylenemethacrylic acid copolymer salt, ethylene-isobutyl acrylate copolymer, ethylene-ethylacrylate copolymer, vinyl acetate-crotonic acid copolymer, vinyl acetate-phthalic anhydride copolymer, styrene-isoprene-styrene block copolymer, styrene-butadiene-styrene block copolymer, styrene-ethylene-butylene-styrene block copolymer, nylon-12, terephthalic acid-1,4-butanediol copolymer, polymethyl acrylate, polymethyl methacrylate, polyethyl acrylate, polyethyl methacrylate, polypropyl acrylate, polypropyl methacrylate, polybutyl acrylate, and polybutyl methacrylate, etc.

Also, the binder layer 20 to be used in this invention may contain one or more adjuvants, such as tackifier, liquid or solid plasticizer, softening agent, organic solvent, petroleum resin, pigment, filler, metallic compound, crosslinking agents wax, surfactant, antioxidant, ultraviolet ray absorbing agent, antidegradation agent, etc. in case it is so desired, providing that they do not hinder any of the effects expected under the invention. The amount of the binder to be applied onto a surface of either the first or second heat-sensitive surfaces 12, 16 generally lies in the range from 3 to 100 $g/m^2$ on a dry basis.

Figure 2:
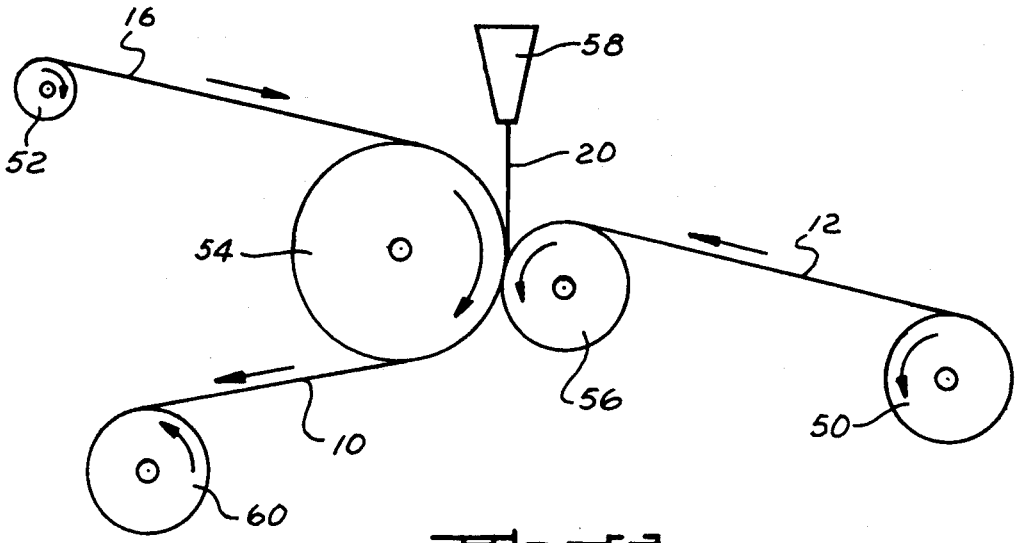
FIG. 2 is a schematic representation showing a method of manufacturing a double-surface heat-sensitive record material of the present invention.

As best shown in FIG. 2, a preferred process of producing the double-surface heat-sensitive record material 10 includes placing the first heat-sensitive record surface 12 on a first supply roll 50, and placing the second heat-sensitive record surface 16 on a second supply roll 52. Second heat-sensitive surface then moves toward and onto a chill roll 54, so that only the second heat-sensitive record layer 18 contacts the chill roll; while first heat-sensitive record surface moves toward and onto a support roll 56 adjacent the chill roll 54, so that only the first heat-sensitive record layer 14 contacts the support roll 56.

A binder container 58 applies binder layer 20 adjacent the chill roll 54 to the top surface 36 of the second base support sheet 34 of the second heat-sensitive record surface 16, or to the bottom surface 44 of the release sheet 40 of the first heat-sensitive record surface 12, or to both the top surface 36 and bottom surface 44 simultaneously, as the first and second heat-sensitive record surfaces 12, 16 respectively roll over the chill roll 54 and adjacent support roll 56. The binder layer 20 may be so applied by conventional, known binder coating means, such as a spray, screen process printing, kiss-roll coater, direct-roll coater, offset-roll coater, gravure-roll coater, reverse-roll coater, bar coater, blade coater, curtain coater, die slot coater, or extrusion lamination. The chill roll 54 is positioned relative to the binder container 58 so that any heat in the binder layer is dissipated before it damages the first or second heat-sensitive record layers 14, 18. The chill roll 54 and support roll 56 are positioned to bring the first heat-sensitive record surface 12, binder layer 20, and second heat-sensitive record surface 16 into pressured contact, as shown in FIG. 2, thereby joining them together to form the double-surface heat-sensitive record material of the present invention, which is taken up for storage on take-up roll 60. The pressured contact varies depending on the specific composition of the double-surface heat-sensitive record material 10, but is generally less than 200 $kg/cm^2$ and preferably less than 50 $kg/cm^2$.

In use, a recording apparatus (not shown) such as a thermal imager or printer forms an image on first heat-sensitive record layer 14 and second heat-sensitive record layer 18. Release liner 22 is then peeled away by conventional means, providing a first printed surface 24, and second printed surface 26, as seen in FIG. 1. First printed surface 24 includes record layer 14, bearing an image formed by the recording apparatus, first base support sheet 28 and pressure-sensitive adhesive layer 48, so that the first printed surface 24 may be used as a label. Second printed surface 26 includes release liner 22, binder layer 20, second base support sheet 34, and second heat-sensitive record layer 18 bearing an image formed by the recording apparatus, so that the second printed surface 26 may be used as a receipt. It is anticipated that soon after the double-surface heat-sensitive record material 10 of the present invention becomes available, a recording apparatus will be developed that can simultaneously form an image on both the first and second opposed heat-sensitive record layers 14, 18, thereby expediting preparation of first and second printed surfaces 24, 26.

It should be understood by those skilled in the art that obvious structural modifications can be made without departing from the spirit of the invention. For example, multiple heat-sensitive record surfaces could be stacked together utilizing substantially the same elements and methods disclosed herein. Accordingly, reference should be made primarily to the accompanying claims rather than the foregoing specifications to determine the scope of the invention.

Having thus described the invention, what is claimed is:

1. A heat-sensitive record material for providing separable thermally printed surfaces, comprising:

a. a first heat-sensitive record surface comprising a first base support sheet, having a top surface and a bottom surface, and a first heat sensitive record layer affixed to the top surface of the first base support sheet;

b. a second heat-sensitive record surface comprising a second base support sheet, having a top surface and a bottom surface, and a second heat sensitive record layer affixed to the bottom surface of the second base support sheet; and c. a binder layer for affixing the first and second heat-sensitive record surfaces in opposed relation, so that the first heat-sensitive record surface produces a first printed surface and the second heat-sensitive record surface produces a second printed surface wherein the binder layer comprises at least one thermoplastic polymer having a vicat softening point of less than 180° C., wherein the thermoplastic polymer is selected from the group including low density polyethylene, atactic polypropylene, ethylene-vinyl acetate copolymer, ethylene-acrylic acid copolymer salt, ethylene-methacrylic methacrylic acid copolymer salt, ethylene-isobutyl acrylate copolymer, ethylene-ethylacrylate copolymer, vinyl acetate-crotonic acid copolymer, vinyl acetate-phthalic anhydride copolymer, styrene-isoprene-styrene block copolymer, styrene-butadiene-styrene block copolymer, styrene-ethylene-butylene-styrene block copolymer, nylon-12, terephthalic acid-1,4-butanediol copolymer, polymethyl acrylate, polymethyl methacrylate, polyethyl acrylate, polyethyl methacrylate, polypropyl acrylate, polypropyl methacrylate, polybutyl acrylate and polybutyl methacrylate.

2. The heat-sensitive record material of claim 1, wherein the first heat-sensitive record surface further comprises a release liner that enables the first printed surface to be separated from the second printed surface.

3. The heat-sensitive record material of claim 2, wherein the first and second heat-sensitive record layers display print after being thermally printed.

4. The heat-sensitive record material of claim 3, wherein the first heat-sensitive record surface further comprises a pressure-sensitive adhesive layer positioned between the release liner and the first base support sheet, so that the first printed surface includes an exposed pressure-sensitive adhesive layer opposed to the first base support sheet after the first printed surface is separated from the second printed surface.

5. In a heat-sensitive label including an exposed first heat-sensitive record layer affixed to a top surface of a first base support sheet, a pressure-sensitive adhesive layer affixed to an opposed bottom surface of the first base support sheet, and a release liner affixed to a surface of the pressure-sensitive adhesive layer opposed to the first base support sheet, the improvement comprising a binder layer affixed to a surface of the release liner opposed to the pressure-sensitive adhesive layer, a second base support sheet affixed to a surface of the binder layer opposed to the release liner, and an exposed second heat-sensitive record layer, so that the release liner enables separation of the release liner, binder layer, second base support sheet and exposed second heat-sensitive record layer from the pressure-sensitive adhesive layer, first base support sheet and exposed first heat-sensitive record layer to form a first printed surface and a second printed surface.

6. The improvement of claim 5, wherein the binder layer comprises at least one thermoplastic polymer for which the vicat softening point is less than 180° C.

7. The improvement of claim 5, wherein the binder layer comprises a thermoplastic polymer selected from the group including low density polyethylene, atactic polypropylene, ethylene-vinyl acetate copolymer, ethylene-acrylic acid copolymer salt, ethylenemethacrylic acid copolymer salt, ethylene-isobutyl acrylate copolymer, ethylene-ethylacrylate copolymer, vinyl acetate-crotonic acid copolymer, vinyl acetate-phthalic anhydride copolymer, styrene-isoprene-styrene block copolymer, styrene-butadiene-styrene block copolymer, styrene-ethylene-butylene-styrene block copolymer, nylon-12, terephthalic acid-1,4-butanediol copolymer, polymethyl acrylate, polymethyl methacrylate, polyethyl acrylate, polyethyl methacrylate, polypropyl acrylate, polypropyl methacrylate, polybutyl acrylate and polybutyl methacrylate.

* * * * *